US009016494B1

(12) United States Patent
Hernandez

(10) Patent No.: US 9,016,494 B1
(45) Date of Patent: Apr. 28, 2015

(54) EXPANDABLE ITEM CARRYING DEVICE

(71) Applicant: Alba Hernandez, Northridge, CA (US)

(72) Inventor: Alba Hernandez, Northridge, CA (US)

( * ) Notice: Subject to any disclaimer, the term of this patent is extended or adjusted under 35 U.S.C. 154(b) by 0 days.

(21) Appl. No.: 14/161,139

(22) Filed: Jan. 22, 2014

(51) Int. Cl.

| | |
|---|---|
| ***B65D 85/72*** | (2006.01) |
| ***B65D 25/28*** | (2006.01) |
| ***B65D 6/18*** | (2006.01) |
| ***B65D 81/38*** | (2006.01) |
| *A45C 7/00* | (2006.01) |
| *A45C 13/26* | (2006.01) |

(52) U.S. Cl.

CPC ..... *B65D 85/72* (2013.01); *A45C 13/26* (2013.01); *B65D 25/2805* (2013.01); *A45C 7/0036* (2013.01); *B65D 11/1833* (2013.01); *B65D 81/3888* (2013.01)

(58) Field of Classification Search

CPC .... B65D 25/28; B65D 81/3888; B65D 81/38; B65D 11/1833; B65D 11/18; B65D 7/26; B65D 7/24; A45C 7/0036; A45C 7/0018; A45C 13/02; A45C 13/26

USPC ..... 220/6, 7, 592.2, 530, 529, 754, 760, 220/759, 650, 646, 639; 190/107, 110, 109, 190/115

See application file for complete search history.

(56) References Cited

U.S. PATENT DOCUMENTS

| | | | | | |
|---|---|---|---|---|---|
| 1,494,195 | A | * | 5/1924 | Smith | 217/122 |
| 2,018,809 | A | * | 10/1935 | Rodgers | 190/103 |
| 3,111,153 | A | * | 11/1963 | Sonka et al. | 206/428 |
| 3,587,795 | A | * | 6/1971 | Berry et al. | 190/109 |
| 4,212,377 | A | * | 7/1980 | Weinreb | 190/109 |
| 4,506,769 | A | | 3/1985 | Franco et al. | |
| 4,561,525 | A | * | 12/1985 | Shidner | 190/106 |
| D348,390 | S | | 7/1994 | Van Ness | |
| 5,472,279 | A | * | 12/1995 | Lin | 383/2 |
| 6,206,224 | B1 | | 3/2001 | Potts et al. | |
| 6,382,377 | B2 | * | 5/2002 | Godshaw | 190/110 |
| 7,121,601 | B2 | | 10/2006 | Mulvihill | |
| 8,287,188 | B2 | | 10/2012 | Hoyord et al. | |
| 2006/0102673 | A1 | | 5/2006 | Collier | |
| 2010/0102100 | A1 | | 4/2010 | Hickey et al. | |
| 2013/0087423 | A1 | | 4/2013 | Bettus et al. | |

* cited by examiner

*Primary Examiner* — Robert J Hicks

(57) ABSTRACT

An expandable item carrying device facilitates carrying items such as groceries and the like. The device includes a container having a bottom wall and a perimeter wall coupled to and extending upwardly from a perimeter edge of the bottom wall defining an interior space. A top edge of the perimeter wall defines an opening into the interior space. The perimeter wall has a pair of opposed ends sides and a pair of longitudinal sides extending between the opposed end sides. The longitudinal sides and the bottom wall are compactable along a longitudinal axis of the bottom wall. A primary handle comprises opposed ends coupled to a first one of the longitudinal sides of the perimeter wall.

14 Claims, 4 Drawing Sheets

EXPANDABLE ITEM CARRYING DEVICE

BACKGROUND OF THE DISCLOSURE

Field of the Disclosure

The disclosure relates to carrying devices and more particularly pertains to a new carrying device for facilitating carrying items such as groceries and the like.

SUMMARY OF THE DISCLOSURE

An embodiment of the disclosure meets the needs presented above by generally comprising a container having a bottom wall and a perimeter wall coupled to and extending upwardly from a perimeter edge of the bottom wall defining an interior space. A top edge of the perimeter wall defines an opening into the interior space. The perimeter wall has a pair of opposed ends sides and a pair of longitudinal sides extending between the opposed end sides. The longitudinal sides and the bottom wall are compactable along a longitudinal axis of the bottom wall. A primary handle comprises opposed ends coupled to a first one of the longitudinal sides of the perimeter wall.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
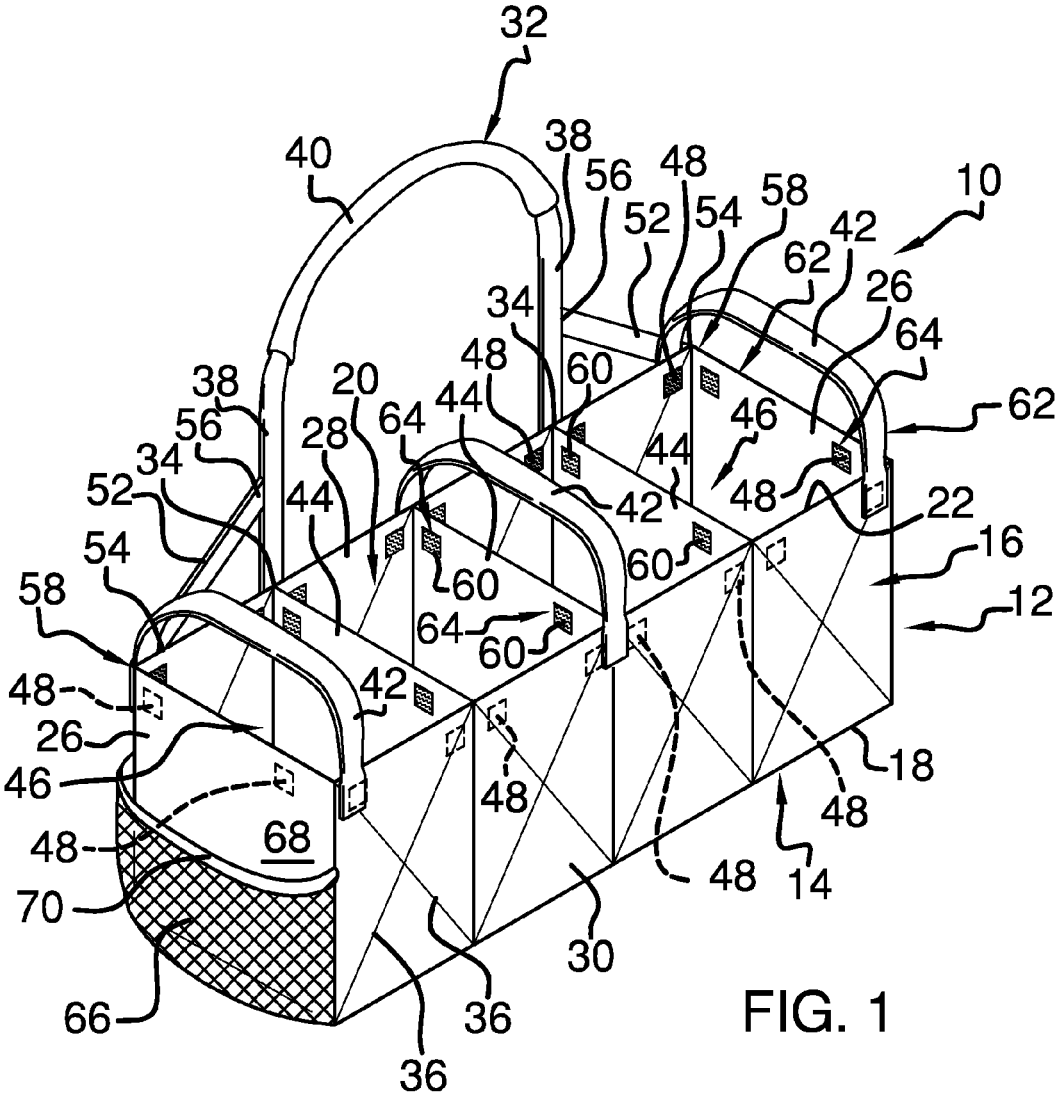
FIG. 1 is a top front side perspective view of a expandable item carrying device according to an embodiment of the disclosure.
Figure 2:
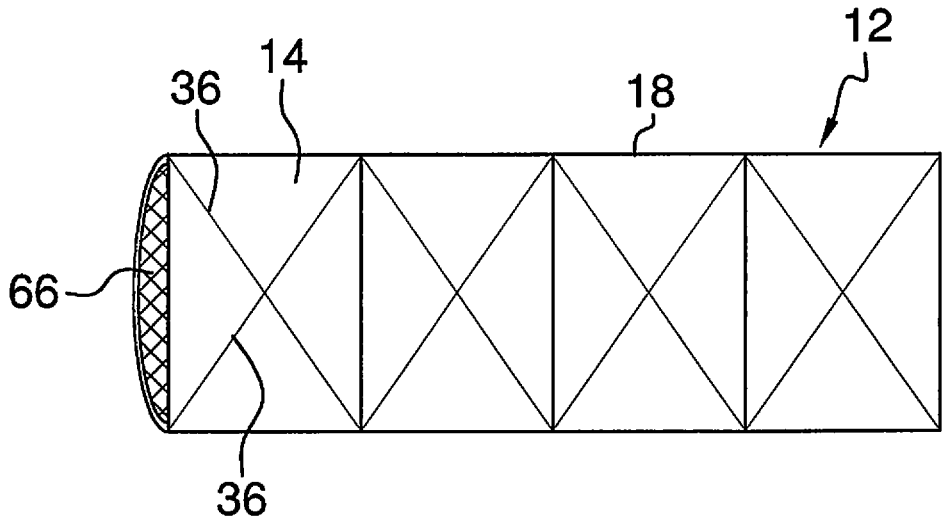
FIG. 2 is a bottom view of an embodiment of the disclosure.
Figure 3:
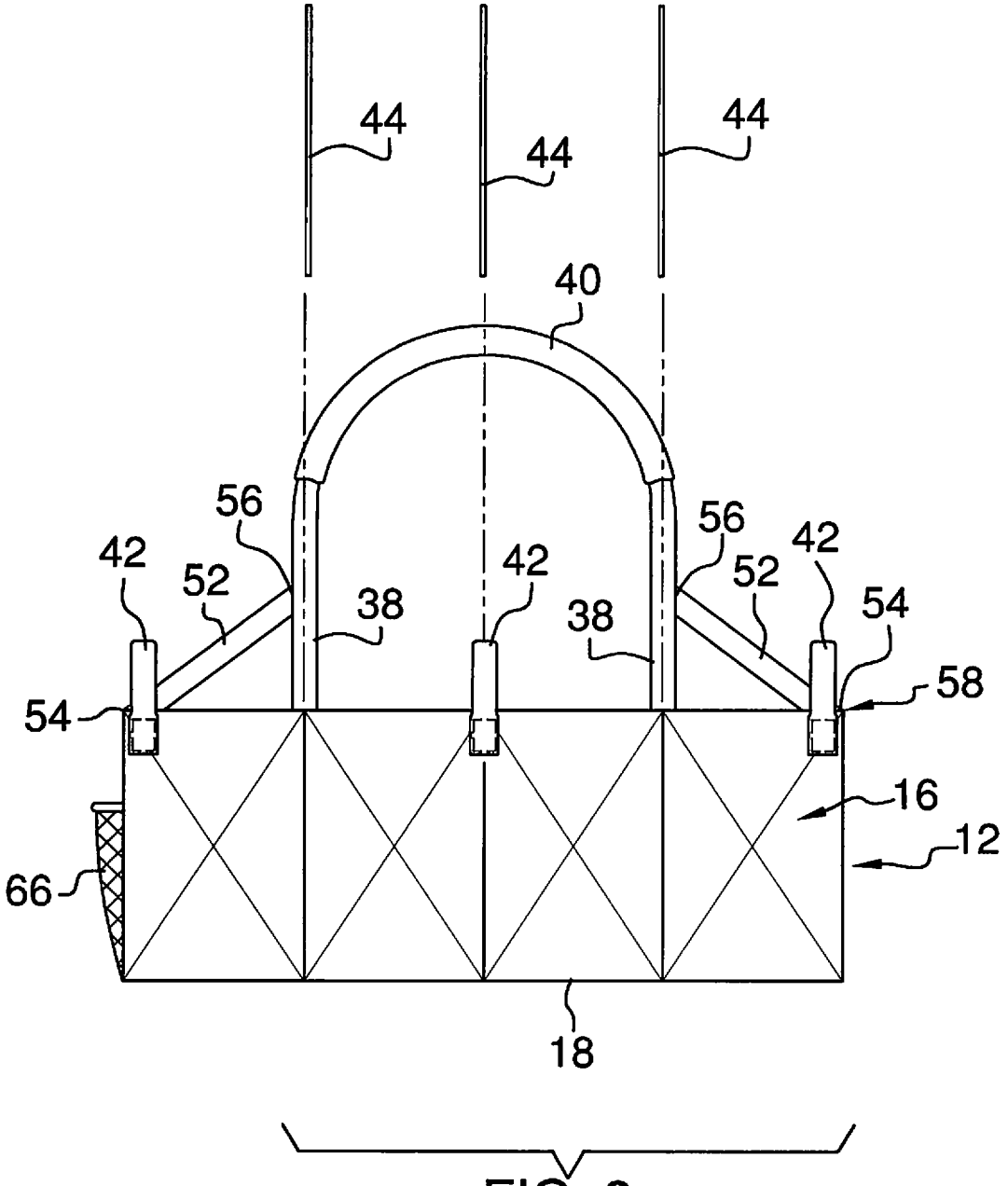
FIG. 3 is a partially exploded front view of an embodiment of the disclosure.
Figure 4:
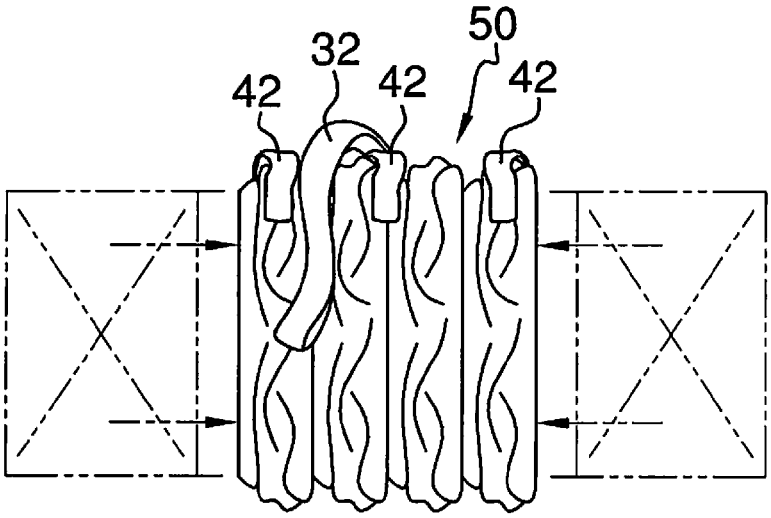
FIG. 4 is a top view of an embodiment of the disclosure in a partially compacted position.
Figure 5:
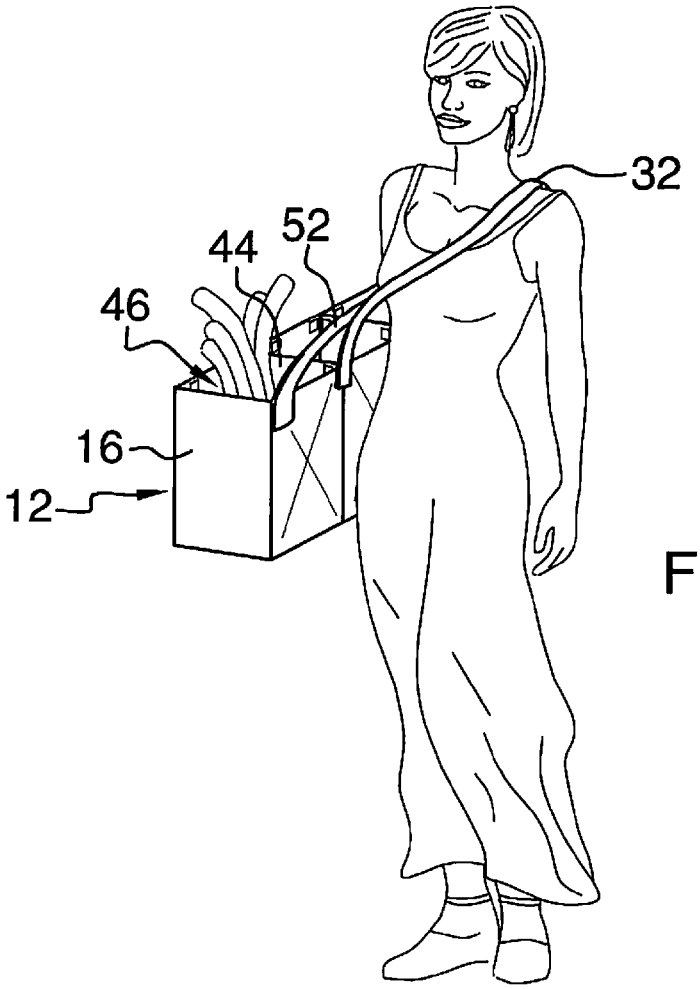
FIG. 5 is a top back side perspective view of an embodiment of the disclosure in use.

With reference now to the drawings, and in particular to FIGS. 1 through 5 thereof, a new carrying device embodying the principles and concepts of an embodiment of the disclosure and generally designated by the reference numeral 10 will be described.

As best illustrated in FIGS. 1 through 5, the expandable item carrying device 10 generally comprises a container 12 having a bottom wall 14 and a perimeter wall 16 coupled to and extending upwardly from a perimeter edge 18 of the bottom wall 14 defining an interior space 20. A top edge 22 of the perimeter wall 16 defines an opening 24 into the interior space 20. The perimeter wall 16 has a pair of opposed ends sides 26 and a pair of longitudinal sides 28, 30 extending between the opposed end sides 26. The longitudinal sides 28, 30 of the perimeter wall 16 and the bottom wall 14 are compactable along a longitudinal axis of the bottom wall 14. The perimeter wall 16 of the container 12 is insulated. The container 12 may include fold lines 36 to facilitate compacting the container 12. The container 12 may also be compactable to bring the two longitudinal sides 28, 30 together if desired.

Each of a plurality of container fasteners 48 is coupled to the perimeter wall 16 proximate the top edge 22 of the perimeter wall 16. Each container fastener 48 is positioned opposite to an associated one of the container fasteners 48 wherein the container fasteners 48 are positioned to hold the container 12 in a compacted position 50. The container fasteners 48 may be complementary portions of hook and loop fastener aligned across the container 12.

A primary handle 32 comprises opposed ends 34. Each of the opposed ends 34 of the primary handle 32 is coupled to a first one of the longitudinal sides 28 of the perimeter wall 16. Each of the opposed ends 34 of the primary handle 32 is coupled to the first one of the longitudinal sides 28 of the perimeter wall 16 of the container 12 in spaced relationship to a respective one of the opposed end sides 26 of the perimeter wall 16 of the container 12. The primary handle 32 has a pair of straight sections 38 and a medial section 40 extending between the straight sections 38. The medial section 40 is arcuate. The straight sections 38 may extend transversely from the top edge 22 of the perimeter wall 16 of the container 12. Each of a plurality of secondary handles 42. Each secondary handle 42 is removably couplable to the perimeter wall 16 such that each secondary handle 42 extends between the longitudinal sides 28, 30 of the perimeter wall 16 across the opening 24.

Each of a pair of braces 52 has a respective first end 54 coupled to the first one of the longitudinal sides 28 of the perimeter wall 16 of the container 12. Each of the braces 52 has a respective second end 56 coupled to the primary handle 32. Each of the braces 52 may be straight extending between the first end 54 of the brace 52 and the second end 56 of the brace 52. The first end 54 of each brace 52 is coupled to the container adjacent to a respective junction 58 of the first one of the longitudinal sides 28 of the perimeter wall 16 and a respective one the opposed end sides 26 of the perimeter wall 16 of the container 12.

Each of a plurality of panels 44 is removably couplable to the container 12 within the interior space 20. The panels 44 divide the interior space 20 into compartments 46. Each of the panels 44 may be insulated. Each of a plurality of panel fasteners 60 is coupled to an associated one of the panels 44. Each panel fastener 60 is alignable between an associated pair 62 of the container fasteners 48 when the panels 44 are positioned in the interior space 20 of the container 12. The panel fasteners 60 may be portions of hook and loop fastener 64. The portions of hook and loop fastener 64 comprising the panel fasteners 60 and the container fasteners 48 may be arranged to facilitate securing of the container 12 in the compacted position 50 with the panels 44 remaining positioned in the interior space 20. This may be achieved by having all portions of the hook and loop fastener 64 facing a particular direction being either hook fastener or loop fastener and having all portions facing in the opposite direction being complementary.

A pocket 66 may be coupled to one of the opposed end sides 26 of the perimeter wall 16. The pocket 66 may be positioned on an exterior face 68 of the one of the opposed end sides 26 of the perimeter wall 16. A top edge 70 of the pocket 66 may be positioned in spaced relationship below the top edge 22 of the perimeter wall 16. The pocket 66 may be constructed of a mesh material.

In use, the panels 44 are positioned in the interior space 20 to provide a desired configuration of compartments 46. The container 12 may be used to carry items such as groceries or the like. When empty, the container 12 may be compacted into the compacted position 50 engaging the container fasteners 48 and the panel fasteners 60 to hold the container 12 in the compacted position 50. The primary handle 32 may be extended over the shoulder to support the container 12 while carrying items. The secondary handles 42 may be used if desired to facilitate grasping, manipulation of, or carrying of the container 12.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. An expandable item carrying device comprising:

a container having a bottom wall and a perimeter wall coupled to and extending upwardly from a perimeter edge of said bottom wall defining an interior space, a top edge of said perimeter wall defining an opening into said interior space, said perimeter wall having a pair of opposed end sides and a pair of longitudinal sides extending between said opposed end sides, said longitudinal sides of said perimeter wall and said bottom wall being compactable along a longitudinal axis of said bottom wall; and a primary handle comprising opposed ends, each of said opposed ends of said primary handle being coupled to a first one of said longitudinal sides of said perimeter wall, each of said opposed ends of said primary handle being coupled to said first one of said longitudinal sides of said perimeter wall of said container in spaced relationship to a respective one of said opposed end sides of said perimeter wall of said container; and a pair of braces, each of said braces having a respective first end coupled to said first one of said longitudinal sides of said perimeter wall of said container, each of said braces having a respective second end coupled to said primary handle in spaced relationship to said opposed ends such that each said brace extends from a lateral side of said primary handle.

2. The device of claim 1, further comprising a plurality of secondary handles, each said secondary handle being removably couplable to said perimeter wall such that each said secondary handle extends between said longitudinal sides of said perimeter wall across said opening.

3. The device of claim 1, further comprising a plurality of panels, each of said panels being removably couplable to said container within said interior space, said panels dividing said interior space into compartments.

4. The device of claim 3, further comprising each of said panels being insulated.

5. The device of claim 1, further comprising said perimeter wall of said container being insulated.

6. The device of claim 1, further comprising a pocket being coupled to one of said opposed end sides of said perimeter wall.

7. The device of claim 6, further comprising said pocket being positioned on an exterior face of said one of said opposed end sides of said perimeter wall.

8. The device of claim 1, further comprising a plurality of container fasteners, each of said container fasteners being coupled to said perimeter wall proximate said top edge of said perimeter wall, each said container fastener being positioned opposite to an associated said container fastener wherein said container fasteners are positioned to hold said container in a compacted position.

9. The device of claim 1, further comprising each of said braces being straight extending between said first end of said brace and said second end of said brace.

10. The device of claim 1, further comprising said first end of each said brace being coupled to said container adjacent to a respective junction of said first one of said longitudinal sides of said perimeter wall and a respective one said opposed end sides of said perimeter wall of said container.

11. The device of claim 8, further comprising:

a plurality of panels, each of said panels being removably couplable to said container within said interior space, said panels dividing said interior space into compartments; and a plurality of panel fasteners, each of said panel fasteners being coupled to an associated one of said panels, each said panel fastener being alignable between an associated pair of said container fasteners when said panels are positioned in said interior space of said container.

12. The device of claim 1, further comprising said primary handle having a pair of straight sections and a medial section extending between said straight sections, said medial section being arcuate.

13. The device of claim 12, further comprising said straight sections extending transversely from said top edge of said container.

14. An expandable item carrying device comprising:

a container having a bottom wall and a perimeter wall coupled to and extending upwardly from a perimeter edge of said bottom wall defining an interior space, a top edge of said perimeter wall defining an opening into said interior space, said perimeter wall having a pair of opposed end sides and a pair of longitudinal sides extending between said opposed end sides, said longitudinal sides of said perimeter wall and said bottom wall being compactable along a longitudinal axis of said bottom wall, said perimeter wall of said container being insulated;

a primary handle comprising opposed ends, each of said opposed ends of said primary handle being coupled to a first one of said longitudinal sides of said perimeter wall, each of said opposed ends of said primary handle being coupled to said first one of said longitudinal sides of said perimeter wall of said container in spaced relationship to a respective one of said opposed end sides of said perimeter wall of said container, said primary handle having a pair of straight sections and a medial section extending between said straight sections, said medial section being arcuate, said straight sections extending transversely from said top edge of said container;

a plurality of secondary handles, each said secondary handle being removably couplable to said perimeter wall such that each said secondary handle extends between said longitudinal sides of said perimeter wall across said opening;

a plurality of panels, each of said panels being removably couplable to said container within said interior space, said panels dividing said interior space into compartments, each of said panels being insulated;

a pocket being coupled to one of said opposed end sides of said perimeter wall, said pocket being positioned on an exterior face of said one of said opposed end sides of said perimeter wall;

a plurality of container fasteners, each of said container fasteners being coupled to said perimeter wall proximate said top edge of said perimeter wall, each said container fastener being positioned opposite to an associated said container fastener wherein said container fasteners are positioned to hold said container in a compacted position;

a pair of braces, each of said braces having a respective first end coupled to said first one of said longitudinal sides of said perimeter wall of said container, each of said braces having a respective second end coupled to said primary handle in spaced relationship to said opposed ends such that each said brace extends from a lateral side of said primary handle, each of said braces being straight extending between said first end of said brace and said second end of said brace, said first end of each said brace being coupled to said container adjacent to a respective junction of said first one of said longitudinal sides of said perimeter wall and a respective one said opposed end sides of said perimeter wall of said container; and a plurality of panel fasteners, each of said panel fasteners being coupled to an associated one of said panels, each said panel fastener being alignable between an associated pair of said container fasteners when said panels are positioned in said interior space of said container.

* * * * *